US009982672B2

(12) United States Patent
Sakai et al.

(10) Patent No.: US 9,982,672 B2
(45) Date of Patent: May 29, 2018

(54) FUEL PUMP

(71) Applicant: DENSO CORPORATION, Kariya, Aichi-pref. (JP)

(72) Inventors: Hiromi Sakai, Kariya (JP); Daiji Furuhashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 102 days.

(21) Appl. No.: 15/154,064

(22) Filed: May 13, 2016

(65) Prior Publication Data

US 2016/0333878 A1 Nov. 17, 2016

(30) Foreign Application Priority Data

May 14, 2015 (JP) ..... 2015-99406

(51) Int. Cl.

| | |
|---|---|
| ***F01C 1/10*** | (2006.01) |
| ***F04C 2/08*** | (2006.01) |
| ***F04C 18/08*** | (2006.01) |
| ***F03C 2/08*** | (2006.01) |
| ***F04C 29/00*** | (2006.01) |
| ***F04C 2/10*** | (2006.01) |
| ***F04C 15/00*** | (2006.01) |
| ***F02M 37/08*** | (2006.01) |
| *F04C 13/00* | (2006.01) |

(52) U.S. Cl.

CPC ..... *F04C 29/0021* (2013.01); *F02M 37/08* (2013.01); *F04C 2/102* (2013.01); *F04C 15/0061* (2013.01); *F04C 15/0065* (2013.01); *F04C 13/005* (2013.01); *F04C 2210/203* (2013.01); *F04C 2230/60* (2013.01); *F04C 2240/30* (2013.01); *F04C 2240/40* (2013.01)

(58) Field of Classification Search

USPC ..... 418/166, 171, 149

See application file for complete search history.

(56) References Cited

U.S. PATENT DOCUMENTS

| | | | | |
|---|---|---|---|---|
| 5,997,262 | A * | 12/1999 | Finkbeiner | F02M 37/041 417/410.4 |
| 8,241,023 | B2 * | 8/2012 | Wilhelm | F01C 21/106 417/410.4 |
| 8,747,089 | B2 * | 6/2014 | Nakamura | F04C 15/0034 251/309 |

FOREIGN PATENT DOCUMENTS

| | | |
|---|---|---|
| JP | 2007-216273 | 8/2007 |
| JP | 2009-281172 | 12/2009 |
| JP | 2013-060901 | 4/2013 |
| JP | 2013-160220 | 8/2013 |

* cited by examiner

*Primary Examiner* — Deming Wan

(74) *Attorney, Agent, or Firm* — Nixon & Vanderhye P.C.

(57) ABSTRACT

A fuel pump includes an inner rotor, an outer rotor, a casing, and a housing. The inner rotor includes outward teeth. The outer rotor includes inward teeth geared with the outward teeth. The casing houses the inner rotor and the outer rotor, and forms a variable capacity pump chamber between the inward teeth and the outward teeth. The housing is formed in a cylindrical shape and includes a cylindrical inner portion, the casing being press fit into the cylindrical inner portion. A recessed portion is formed at a predetermined position in a circumferential direction of an outer circumferential surface of the casing, the recessed portion being recessed toward a radial direction center of the outer circumferential surface.

5 Claims, 12 Drawing Sheets

FUEL PUMP

CROSS REFERENCE TO RELATED APPLICATION

The present application is based on Japanese Patent Application No. 2015-99406 filed on May 14, 2015, disclosure of which is incorporated herein by reference.

TECHNICAL FIELD

The present disclosure relates to a fuel pump that discharges a liquid fuel.

BACKGROUND

This kind of fuel pump includes an inner rotor having outward teeth, an outer rotor having inward teeth that engage with the outward teeth, and a casing that houses these rotors. The outer rotor is disposed eccentrically with respect to the inner rotor. Then, when the inner rotor is rotated, this rotation force is transmitted from the outward teeth to the inward teeth and the outer rotor also rotates. When both rotors rotate in this manner, the capacity of a pump chamber formed between the outward teeth and the inward teeth changes. As the capacity of the pump chamber increases, fuel is sucked from an intake port into the pump chamber, and then as the capacity of the pump chamber decreases, the fuel is compressed in the pump chamber and then discharged from a discharge port (refer to JP 2013-60901 A).

Further, conventional pumps include a cylindrical shaped housing that houses the casing therein. Typically, the casing is fixed to the housing by press fitting the casing in a cylindrical inner portion of the housing.

SUMMARY

In the fuel pump of the above described configuration, there is a chance for foreign substances included in the fuel to become stuck between the two rotors, trapping the rotors in a locked state where the outer rotor cannot rotate with respect to the inner rotor. In addition, since the outer rotor is eccentrically disposed as described above, when a rotation driving force is applied to the inner rotor in the locked state, the two rotors become a single body and are unable to freely rotate inside of the casing (pump chamber). In this case, the rotors and the casing become a single body and the housing inner portion tries to rotate. For this reason, a large force is applied in which the casing tries to rotate with respect to the housing. As a result, there is a chance for the casing, which should be fixedly press fit in the housing, to rotate, thereby causing the casing to be displaced with respect to the housing in the rotation direction. In this case, the position of the intake port or the discharge port may be offset from an optimum position, causing pump efficiency to deteriorate and discharge amount to decrease. In particular, if a small positional displacement occurs, then the discharge amount only decreases by a small amount, and it is difficult to notice that pump efficiency is decreased due to the positional displacement.

In view of the above, it is an object of the present disclosure to provide a fuel pump that aims to suppress pump efficiency from deteriorating due to a positional displacement of the casing.

In one aspect of the present disclosure, a fuel pump includes an inner rotor including outward teeth, an outer rotor including inward teeth, the inward teeth being geared with the outer teeth, a casing that houses the outer rotor and the inner rotor, the casing forming a variable capacity pump chamber between the inward teeth and the outward teeth, and a housing formed in a cylindrical shape including a cylindrical inner portion, the casing being press fit into the cylindrical inner portion, wherein a recessed portion is formed at a predetermined position in a circumferential direction of an outer circumferential surface of the casing, the recessed portion being recessed toward a radial direction center of the outer circumferential surface.

According to this aspect of the present disclosure, a portion of the housing which does not face the recessed portion (press fitting deformation portion) is deformed so as to be enlarged in a radial direction (press fitting deformation) when the casing is press fit into the housing. Meanwhile, regarding a portion of the housing which faces the recessed portion (recess facing portion), press fitting deformation, i.e., enlarging in the radial direction, is suppressed. As a result, the recess facing portion becomes inserted into the recessed portion. Thus, even if a large rotation force is applied to the casing due to foreign substances becoming stuck as described above, the recess facing portion is caught on the wall surface of the recessed portion, and functions as a rotation stopper for the casing. As a result, according to the present aspect, it is possible to suppress the casing from being displaced in the rotation direction, and it is possible to suppress pump efficiency from deteriorating due to such a displacement

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Next, each embodiment of a fuel pump according to the present disclosure will be explained with reference to the figures.

First Embodiment

A fuel pump according to the present embodiment is mounted in a vehicle. A fluid pumping target of the fuel pump is a liquid fuel used for combustion in an internal combustion engine. Specifically, the pumping target is a diesel oil used for combustion in a self-ignition compression type internal combustion engine, and the fuel pump is disposed within a fuel tank.

Figure 1:
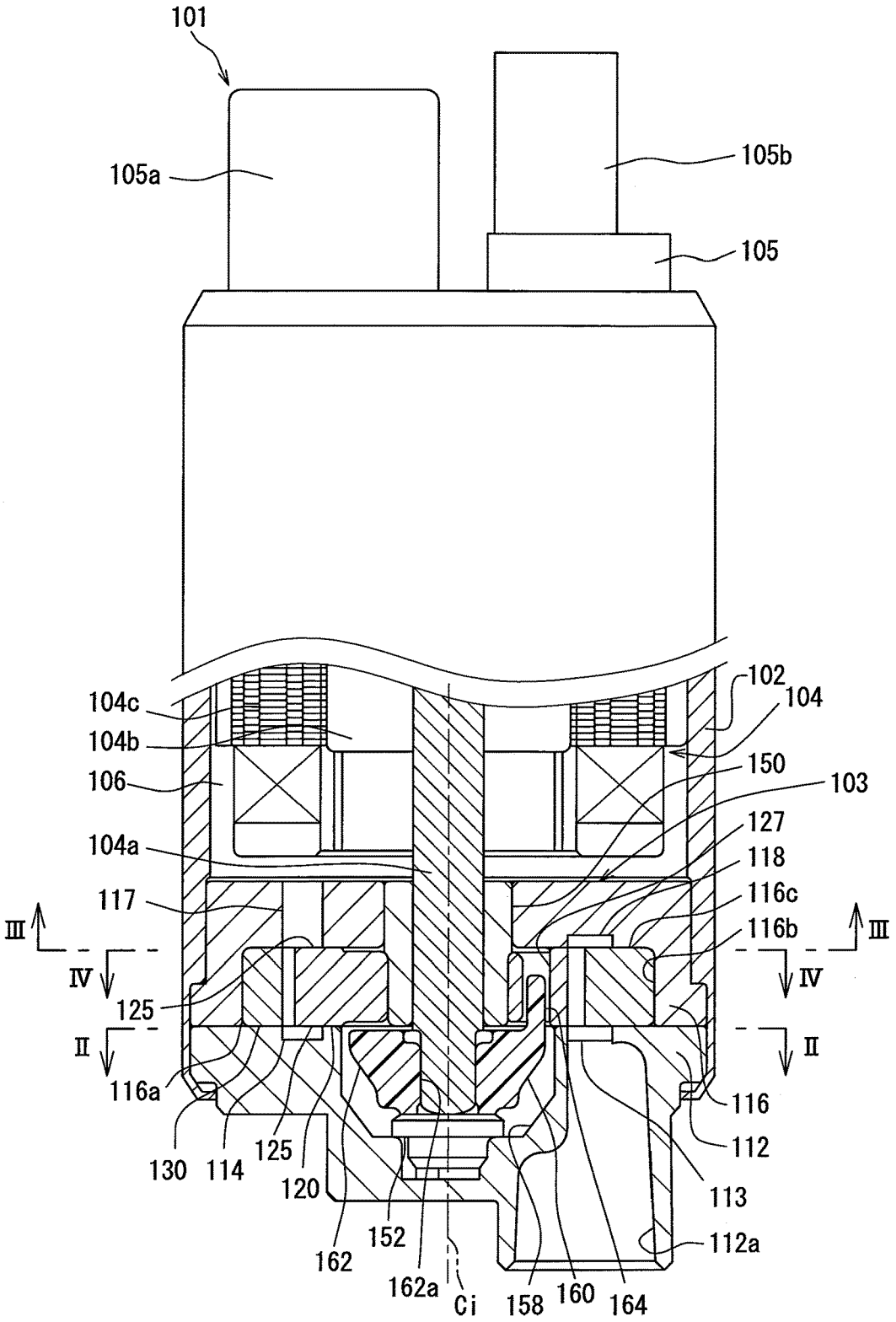
FIG. 1 is a partial cross sectional front view of a fuel pump according to a first embodiment of the present disclosure.

As shown in FIG. 1, a fuel pump 101 according to the present embodiment is a displacement type rotary pump, and is an inscribed type gear pump. The fuel pump 101 includes a housing 102, a pump body 103, an electric motor 104, and a side cover 105. The pump body 103 and the electric motor 104 are housed inside the cylindrical shaped housing 102, and are arranged to line up along an axial direction. The housing 102 includes two opening portions positioned at either end in the axial direction. The side cover 105 is installed in the opening portion of the housing 102 positioned toward the electric motor 104.

The side cover 105 includes an electric connector 105*a* for energizing the electric motor 104, and a discharge port 105*b* for discharging fuel. According to this fuel pump 101, the rotating shaft 104*a* of the electric motor 104 is rotatably driven by energization from an external circuit through the electric connector 105*a*. As a result, by using the driving force of the rotating shaft 104*a* of the electric motor 104, fuel is sucked in and pressurized due to the outer rotor 130 and the inner rotor 120 of the pump body 103 rotating, and then this fuel is discharged from the discharge port 105*b*. Further, regarding the fuel pump 101, a diesel fuel having a higher viscosity than gasoline is discharged as the fuel.

According to the present embodiment, the electric motor 104 is an inner rotor type brushless motor arranged with magnets 104*b* forming 4 poles and coils 104*c* forming 6 slots. For example, when the ignition switch of the vehicle is switched on, or during a starting preparation of the internal engine, then at this timing, the electric motor 104 performs a positioning control that causes the rotating shaft 104*a* to rotate in a driving rotation side or a driving rotation opposite side. Thereafter, the electric motor 104 performs a driving control that causes the rotating shaft 104*a* to rotate in the driving rotation side from the position determined during the positioning control.

Here, the driving rotation side indicates a positive direction of a rotation direction Ri in the circumferential direction of the inner rotor 120. The driving rotation opposite side indicates a negative direction of the rotation direction Ri in the circumferential direction of the inner rotor 120.

Next, the pump body 103 will be explained in detail. The pump body 103 includes a cover 112, a casing 116, the inner rotor 120, the outer rotor 130, and a joint member 160. A rotor housing chamber 11*a* is forming within the casing 116 and the cover 112. The inner rotor 120 and the outer rotor 130 are housed in this rotor housing chamber 11*a*.

The cover 112 is formed in a disc shape from metal. The cover 112 juts out from an end of the housing 102 opposite from the side cover 105 to interpose the electric motor 104 in the axial direction.

Figure 2:
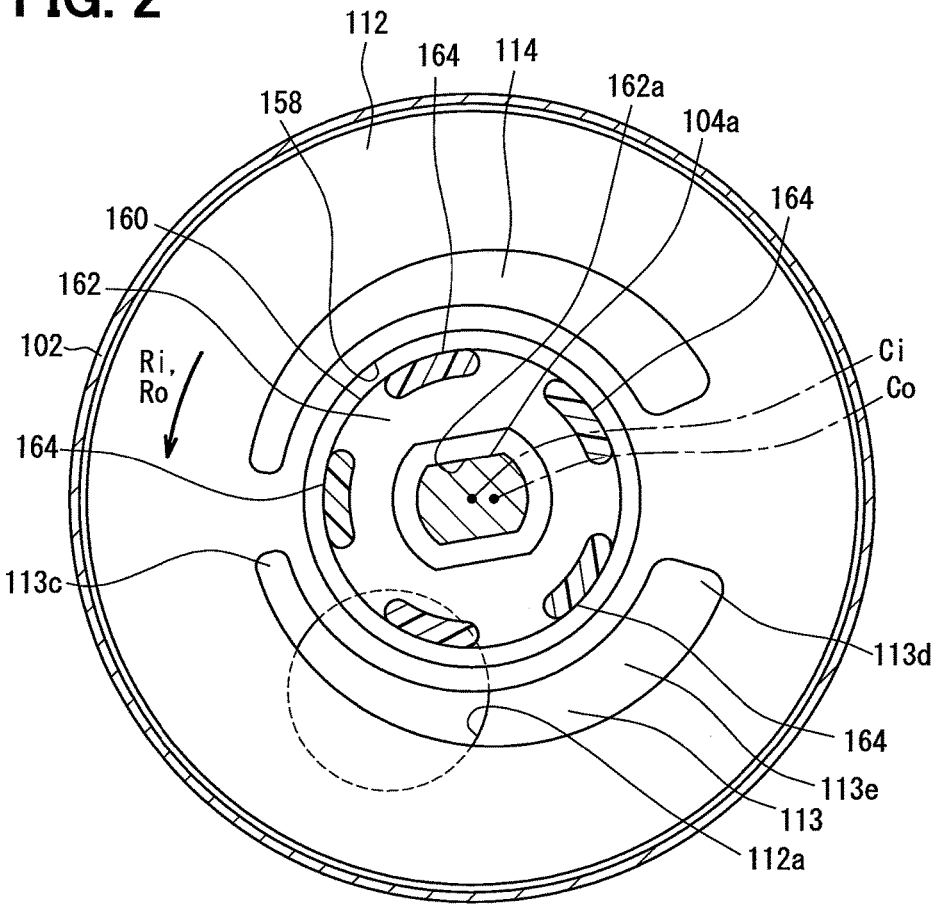
FIG. 2 is a cross section view along line II-II of FIG. 1.
Figure 4:
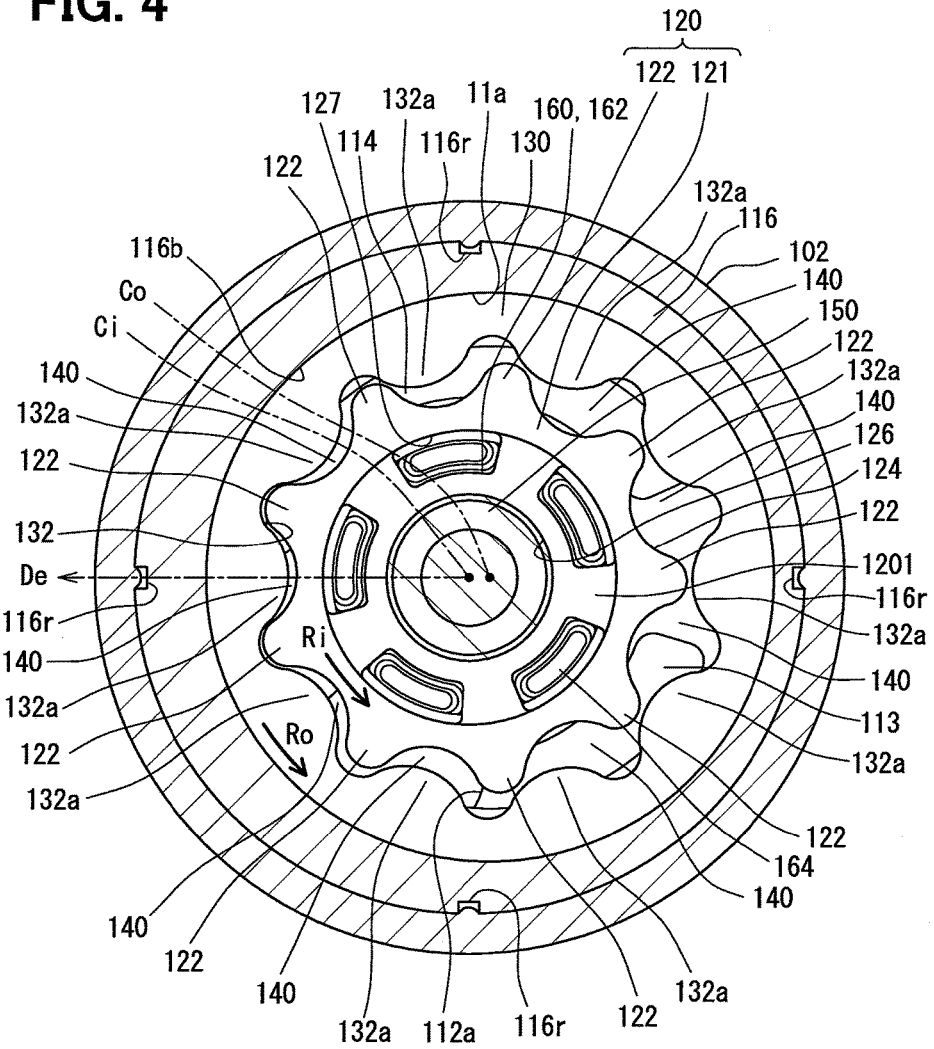
FIG. 4 is a cross section view along line IV-IV of FIG. 1.
Figure 5:
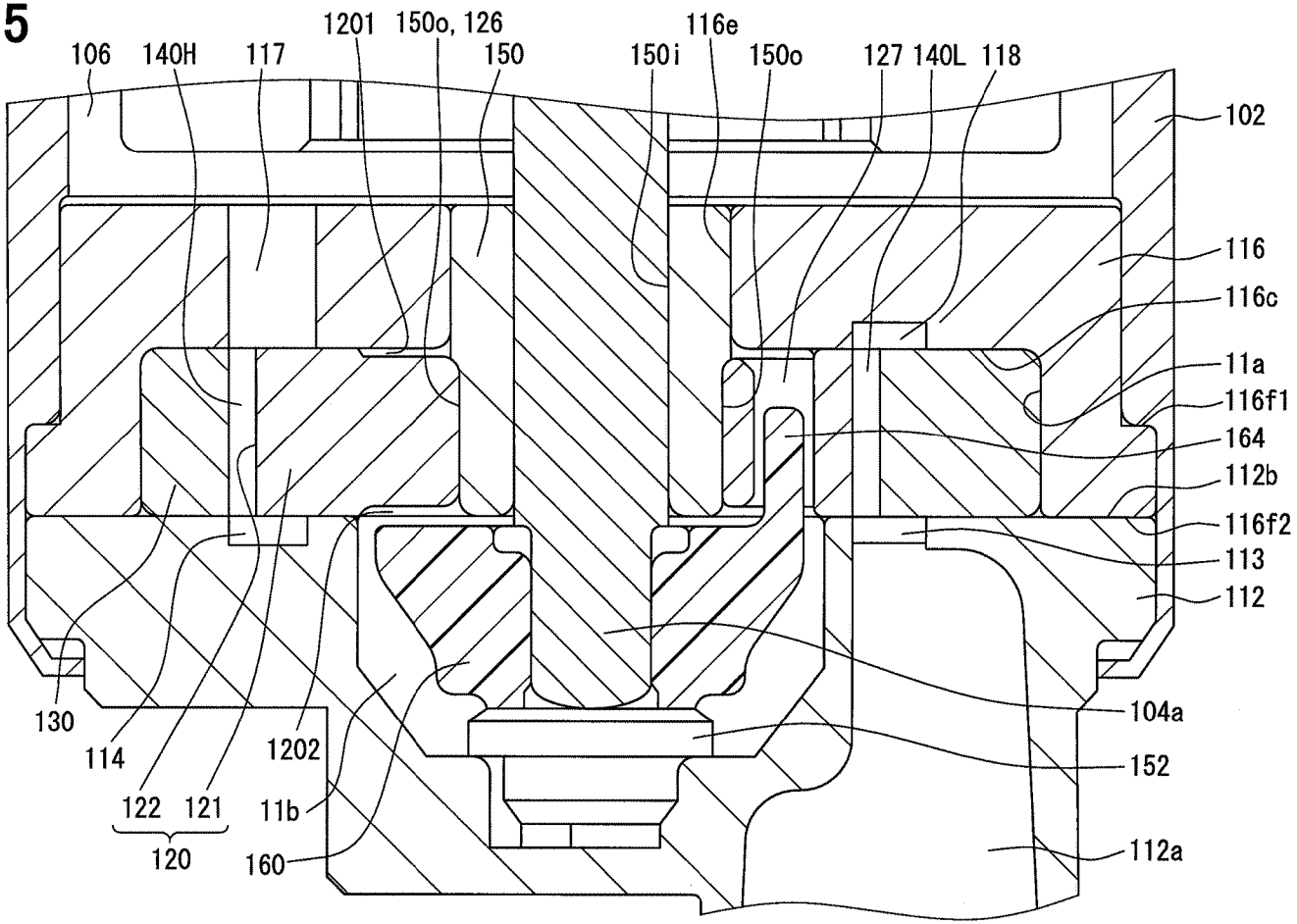
FIG. 5 is an enlarged view.

The cover 112, shown in FIGS. 1, 2, and 5, forms an intake passage 112*a* and an intake groove 113 in order to intake fuel from outside. The intake passage 112*a* is shaped as a cylindrical hole, while the intake groove 113 is arc-shaped. The intake groove 113 opens toward the casing 116 side of the cover 112, and is in communication with the intake passage 112*a* due to the intake passage 112*a* being open at a predetermined location of a groove bottom portion 113*e*. The portion of the intake groove 113 in communication with the intake passage 112*a* penetrates through the cover 112 along the axial direction. The portion of the intake groove 113 not in communication with the intake passage 112*a* is a closed-bottom shape that does not penetrate. As shown in FIG. 2, the intake groove 113 extends with a length of less than a semicircle along the rotation direction Ri (refer to FIG. 4 as well) of the inner rotor 120. The intake groove 113 becomes wider in the rotation axial direction as going from a start edge portion 113*c* toward an end edge portion 113*d* of rotation directions Ri, Ro.

The cover 112 forms a joint housing chamber 11*b* at a location that faces the inner rotor 120 on an inner center line Ci. The joint housing chamber 11*b* is has a recessed hole shape, and a body portion 162 of the joint member 160 is rotatably disposed therein.

Figure 3:
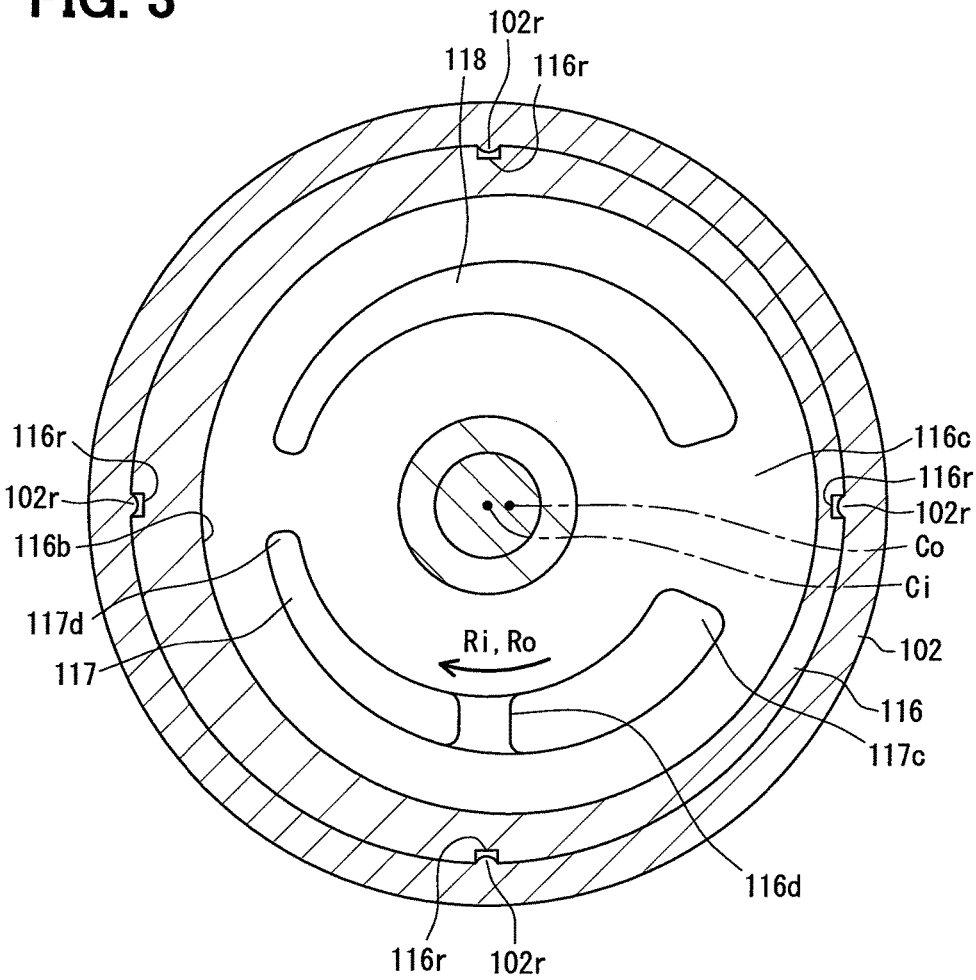
FIG. 3 is a cross section view along line of FIG. 1.

The casing 116 shown in FIGS. 1 and 3 to 6 is formed by metal in a cylindrical shape with a closed bottom. An opening portion 116*a* of the casing 116 is covered by the cover 112 so as to be airtight over its entire circumference. An inner circumferential surface 116*b* of the casing 116 is, as shown in FIGS. 1 and 4 in particular, formed in a cylindrical hole shape that is eccentric from the inner center line Ci of the inner rotor 120.

The casing 116 forms a discharge passage 117 in order to discharge fuel through a high pressure passage 106 and out of the discharge port 105*b*. The high pressure passage 106 is between the housing 102 and the electric motor 104. The discharge passage 117 is an arc-shaped hole. Further, the discharge passage 117 penetrates a recessed bottom portion 116*c* of the casing 116 in the axial direction. As shown in FIG. 3 in particular, the discharge passage 117 extends with a length of less than semicircle along the rotation direction Ri of the inner rotor 120. Here, the discharge passage 117 decreases in width in the rotation radial direction as moving from a start edge portion 117*c* toward an end edge portion 117*d*.

Further, the casing 116 includes a reinforcing rib 116*d* in the discharge passage 117. The reinforcing rib 116*d* is integrally formed with the casing 116, and reinforces the casing 116 by straddling the discharge passage 117 in a direction intersecting the rotating direction Ri of the inner rotor 120.

An opposing intake groove 118, shown in FIG. 3, is formed at a location of the recessed bottom portion 116*c* of the casing 116 that faces the intake groove 113, so as to interpose a pump chamber 140 (described later) between the inner rotor 120 and the outer rotor 130. The opposing intake groove 118 is an arc-shaped groove that corresponds to a shape of the intake groove 113 projected in the axial direction. Due to this, in the casing 116, the contours of the discharge passage 117 and the opposing intake groove 118 are disposed in a roughly line symmetrical manner.

Meanwhile, as shown in FIG. 2 in particular, an opposing discharge groove 114 is formed at a location of the cover 112 which faces the discharge passage 117 to interpose the pump chamber 140. The opposing discharge groove 114 is an arc-shaped groove, and corresponds to the shape of the discharge passage 117 projected in the axial direction. As a result, in the cover 112, the contours of the intake groove 113 and the opposing discharge groove 114 are formed in a roughly line symmetrical manner. The outlines of the intake groove 113, the opposing discharge groove 114, the discharge passage 117, and the opposing intake groove 118 are formed to extend parallel along the rotation trajectories of the outward teeth 122 and the inward teeth 132*a*.

As shown in FIG. 1, a radial bearing 150 is fixedly fitted in the recessed bottom portion 116*c* of the pump casing 116 on the inner center line Ci, in order to bear the rotating shaft 104*a* of the electric motor 104 in the radial direction. Meanwhile, a thrust bearing 152 is fixedly fitted in the cover 112 on the inner center line Ci, in order to bear the rotating shaft 104*a* in the axial direction.

As shown in FIGS. 1, 4, and 5, the rotor housing chamber 11*a*, which houses the inner rotor 120 and the outer rotor 130, is formed by the recessed bottom portion 116*c* and the inner circumferential surface 116*b* of the casing 116 as well as the cover 112. The inner rotor 120 shares the inner center line Ci with the rotating shaft 104*a*, and is eccentrically disposed in the rotor housing chamber 11*a*. A throughhole 126, into which the radial bearing 150 is inserted, is formed in a body portion 121 of the inner rotor 120. As the inner rotor 120 rotates, the inner wall surface of the throughhole 126 slides against a cylindrical outer circumferential surface 150*o*. Accordingly, the inner rotor 120 is borne by the radial bearing 150 in the radial direction. Further, sliding surfaces 125 of both sides in the axial direction of the inner rotor 120 are borne by the recessed bottom portion 116*c* of the casing 116 and the cover 112.

Further, the inner rotor 120 includes insertion holes 127 at locations facing the joint housing chamber 11*b*. The insertion holes 127 are recessed along the axial direction. In the present embodiment, the insertion holes 127 are multiply disposed (5 in the present embodiment) with even spacing in a circumferential direction along the rotation direction Ri, and each insertion hole 127 penetrates until the recessed bottom portion 116*c*. Each insertion hole 127 is inserted with a respective corresponding leg portion 164 of the joint member 160. Accordingly, the driving force of the rotating shaft 104*a* is transmitted through the joint member 160 to the inner rotor 120. In this regard, the inner rotor 120 is rotatable in a circumferential direction about the inner center line Ci according to the rotation of the rotating shaft 104*a* of the electric motor 104. While rotating, the sliding surfaces 125 of the inner rotor 120 slide on the cover 112 and the recessed bottom portion 116*c*.

The inner rotor 120 includes the plurality of outward teeth 122, which are lined up with even spacing in a circumferential direction along the rotation direction Ri, on an outer circumferential portion 124. Each outward tooth 124*a* is positioned so as to be able to face the intake groove 113, the discharge passage 117, the opposing discharge groove 114, and the opposing intake groove 118 in the axial direction according to the rotation of the inner rotor 120. Due to this, the inner rotor 120 is suppressed from clinging onto the recessed bottom portion 116*c* and the cover 112.

As shown in FIGS. 1, 4, and 5, the outer rotor 130 is disposed coaxially in the rotor housing chamber 11*a*, and is eccentric with respect to the inner center line Ci of the inner rotor 120. Due to this, the inner rotor 120 is eccentric with respect to the outer rotor 130 in an eccentric direction De, which is a radial direction. The outer rotor 130 is borne in the radial direction by the inner circumferential surface 116*b* of the casing 116. Further, the outer rotor 130 is borne in the axial direction by the cover 112 and the recessed bottom portion 116*c* of the casing 116. Due to these bearings, the outer rotor 130 is rotatable in a fixed rotation direction Ro about an outer center line Co, which is eccentric from the inner center line Ci.

The outer rotor 130 includes the plurality of inward teeth 132*a*, which are lined up with even spacing in the rotation direction Ro, on an inner circumferential portion 132. Each inward tooth 132*a* is positioned so as to be able to face the intake groove 113, the discharge passage 117, the opposing discharge groove 114, and the opposing intake groove 118 in the axial direction according to the rotation of the outer rotor 130. Due to this, the outer rotor 130 is suppressed from clinging onto the recessed bottom portion 116*c* and the cover 112.

A fuel pressure (discharge pressure) in the discharge passage 117 is applied to press the inner rotor 120 and the outer rotor 130 toward the intake passage 112*a* in the axial direction. Meanwhile, a fuel pressure in the opposing discharge groove 114 is also a discharge pressure, and is applied to press the inner rotor 120 and the outer rotor 130 toward the electric motor 104 in the axial direction. Then, since the opposing discharge groove 114 is disposed to face the discharge passage 117, the balance of these fuel pressures suppresses the inner rotor 120 and the outer rotor 130 from slanting due to discharge pressures.

In the same manner, since the opposing intake groove 118 is disposed to face the intake groove 113, a fuel pressure in the opposing intake groove 118 (an intake pressure) and a fuel pressure in the intake groove 113 (an intake pressure) are balanced, which suppresses the inner rotor 120 and the outer rotor 130 from slanting due to intake pressures.

The outward teeth 122 and the inward teeth 132*a* are shaped to draw the trajectories of trochoid curves, and the number of inward teeth 132*a* is set to be greater than the number of outward teeth 122 by 1. The inner rotor 120 meshes in an eccentric manner relative to the outer rotor 130 in the eccentric direction De. Due to this, the pump chamber 140 is formed in the rotor housing chamber 11*a* between the outward teeth 122 and the inward teeth 132*a*. The pump chamber 140 transforms due to the outer rotor 130 and the inner rotor 120 rotating, such that the capacity of the pump chamber 140 increases and decreases.

As the inner rotor 120 and the outer rotor 130 rotate, a capacity of the pump chamber 140 at connected portions, which face the intake groove 113 and the opposing intake groove 118, increases. As a result, fuel is sucked in from the intake passage 112*a* through the intake groove 113 and into the pump chamber 140. At this time, since the intake groove 113 widens as going from the start edge portion 113*c* toward the end edge portion 113*d* (refer to FIG. 2 as well), the amount of fuel sucked through this intake groove 113 corresponds to the capacity increase amount of the pump chamber 140. Further, the above described portions of the pump chamber 140, whose capacity increases to suck in fuel, are referred to as a negative pressure portion 140L.

As the inner rotor 120 and the outer rotor 130 rotate, a capacity of the pump chamber 140 at connected portions, which face the discharge passage 117 and the opposing discharge groove 114, decreases. As a result, at the same time as the above described suction function, fuel is discharged from the pump chamber 140, through the discharge passage 117, and into the high pressure passage 106. At this time, since the discharge passage 117 decreases in width as going from the start edge portion 117*c* toward the end edge portion 117*d* (refer to FIG. 3 as well), the amount of fuel discharged through this discharge passage 117 corresponds to the capacity decrease amount of the pump chamber 140. Further, the above described portions of the pump chamber 140, whose capacity decreases to compress fuel, are referred to as a high pressure portion 140H.

The joint member 160 is formed of synthetic resin, such as polyphenylene sulfide (PPS) resin or the like. The joint member 160 hooks up the rotating shaft 104*a* with the inner rotor 120, thereby causing this inner rotor 120 to rotate in the circumferential direction. The joint member 160 includes a body portion 162, and leg portions 164.

The body portion 162 is formed with a cylindrical shape having a fitting hole 162*a* opening at a central portion thereof. The body portion 162 is disposed within the joint housing chamber 11*b* formed in the cover 112. By inserting the rotating shaft 104*a* through this fitting hole 162*a*, the body portion 162 is fixedly fitted with the rotating shaft 104*a*.

The leg portions 164 are multiply disposed according to the number of the insertion holes 127 of the inner rotor 120. Specifically, the leg portions 164 are numbered to avoid the numbers of poles and slots of the electric motor 104, in order to reduce the effects of torque ripple from the electric motor 104. In particular, 5 leg portions 164, which is a prime number, are provided. In this manner, the leg portions 164 are disposed to extend along the axial direction from multiple locations (5 locations in the present embodiment) which are more toward the outer circumferential side than the fitting hole 162*a* (i.e., a fitting location) of the body portion 162. The plurality of leg portions 164 are disposed with even spacing in the circumferential direction. Each leg portion 164 is an elastic element, and by extending along the axial direction, is able to elastically deform. When the rotating shaft 104*a* is rotatably driven, each leg portion 164 bends due to elastic deformation according to the corresponding insertion hole 127. Accordingly, dimension errors in the circumferential direction of each insertion hole 127 and each leg portion 164, which may occur during manufacturing, are absorbed, and the leg portions 164 contact the insertion holes 127. Due to this, the joint member 160 transmits the driving force of the rotating shaft 104*a* through the plurality of leg portions 164 to the inner rotor 120.

As shown in FIG. 5, the radial bearing 150 is formed in a cylindrical shape and is made from a resin-coated metal. The rotating shaft 104*a* is inserted into an cylindrical inner portion of the radial bearing 150, and the rotating shaft 104*a* is rotatably slip supported on a cylindrical inner circumferential surface 150*i* of the radial bearing 150. A portion of the radial bearing 150 is fixedly press fit in a throughhole 116*e* of the casing 116. Due to this press fitting, the radial bearing 150 is fixed to the casing 116 in an unrotatable state. Further, a portion of the radial bearing 150 is inserted into a cylindrical inner portion of the inner rotor 120, so the inner rotor 120 is rotatably slip supported on the cylindrical outer circumferential surface 150*o*.

The high pressure fuel in the high pressure passage 106 enters (at a sliding surface) between the cylindrical inner circumferential surface 150*i* of the radial bearing 150 and the outer circumferential surface of the rotating shaft 104*a*. After pressure drops at this sliding surface, the fuel leaks into the joint housing chamber 11*b*. Accordingly, a fuel (mid-pressure fuel), which is lower pressure than the high pressure in the high pressure passage 106 and higher pressure than the intake fuel in the intake passage 112*a*, accumulates in the joint housing chamber 11*b*.

As shown in FIGS. 4 and 5, a first groove 1201 is formed in a surface of the inner rotor 120 that faces the casing 116. The first groove 1201 is formed in an annular shape around the radial bearing 150. In addition, a second groove 1202 is formed in a surface of that inner rotor 120 that faces away from the casing 116. The second groove 1201 extends in an annular shape with the same outer diameter as the first groove 1201.

The high pressure fuel in the discharge passage 117 enters (at a sliding surface) between the inner rotor 120 and the casing 116, and after pressure drops at this sliding surface, the fuel leaks into the first groove 1201. Accordingly, a fuel (mid-pressure fuel), which is lower pressure than the high pressure in the high pressure passage 106 and higher pressure than the intake fuel in the intake passage 112*a*, accumulates in the first groove 1201. Meanwhile, the second groove 1202 is filled with the mid-pressure fuel in the joint housing chamber 11*b*. Since the first groove 1201 and the second groove 1202 are formed in annular shapes with the same outer dimensions, the pressures (mid-pressure) of the fuel accumulated in the first groove 1201 and the fuel filled in the second groove 1202 are balanced, and the inner rotor 120 is suppressed from titling due to mid-pressure fuels.

Next, a configuration in which the casing 116 is fixedly press fit in the housing 102 will be explained in detail.

Figure 6:
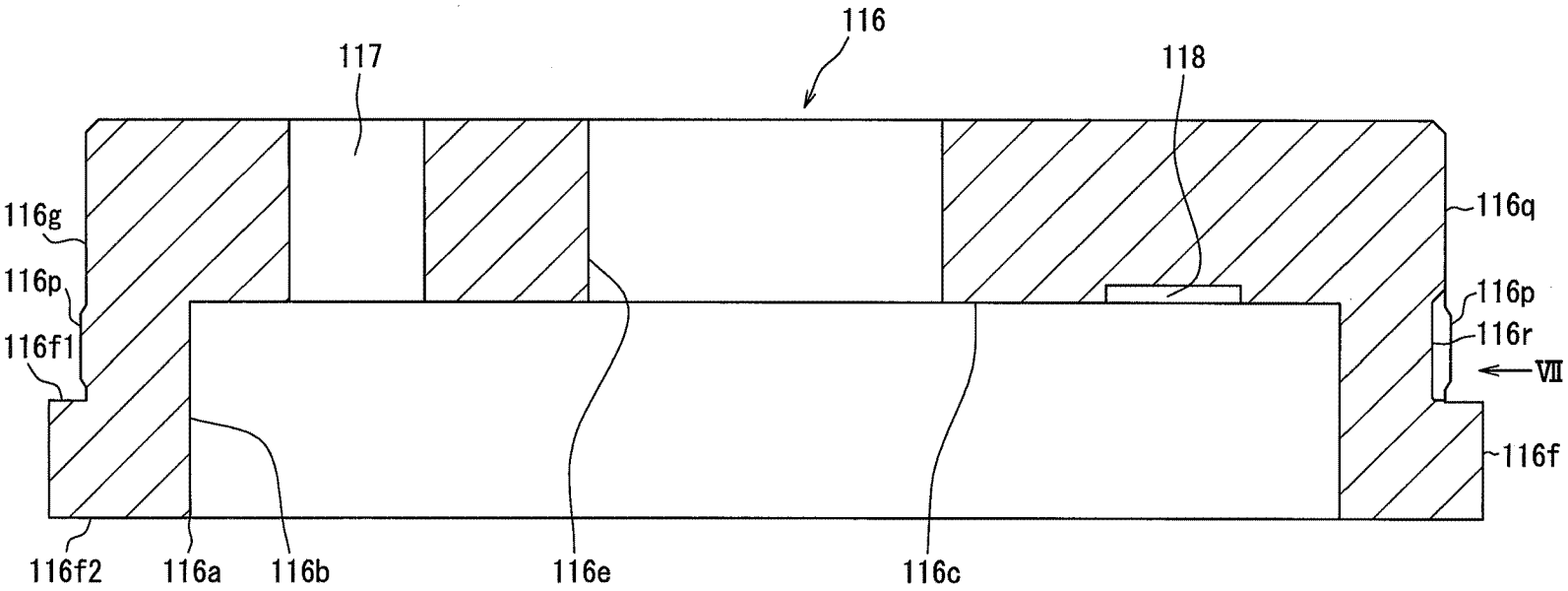
FIG. 6 is a cross section view showing a standalone casing according to a first embodiment.

As shown in FIG. 6, the casing 116 includes an expanded diameter portion 116*f*, a press fitting portion 116*p*, and a guide portion 116*q*. These portions form an outer circumferential surface 116*g* of the casing 116. The expanded diameter portion 116*f*, the press fitting portion 116*p*, and the guide portion 116*q* are disposed to line up in the axial direction of the casing 116 (the up-down direction in FIG. 6), in this order, from the cover 112 side.

The outer dimension of the guide portion 116*q* is set to be slightly smaller than the inner dimension of the housing 102. Due to this, a clearance is formed between the guide portion 116*q* and the housing 102, and the guide portion 116*q* may be inserted into the housing 102 without the housing 102 deforming (see FIG. 8).

The outer dimension of the press fitting portion 116*p* is set to be slightly greater than the inner dimension of the housing 102. Accordingly, when the press fitting portion 116*p* is inserted into the housing 102, the inner dimension of the housing 102 is pressed and expanded until reaching the outer dimension of the press fitting portion 116*p*, and the press fitting portion 116*p* is press fit into the housing 102 (refer to FIG. 9). Accordingly, the casing 116 is fixedly press fit into the housing 102.

Figure 7:
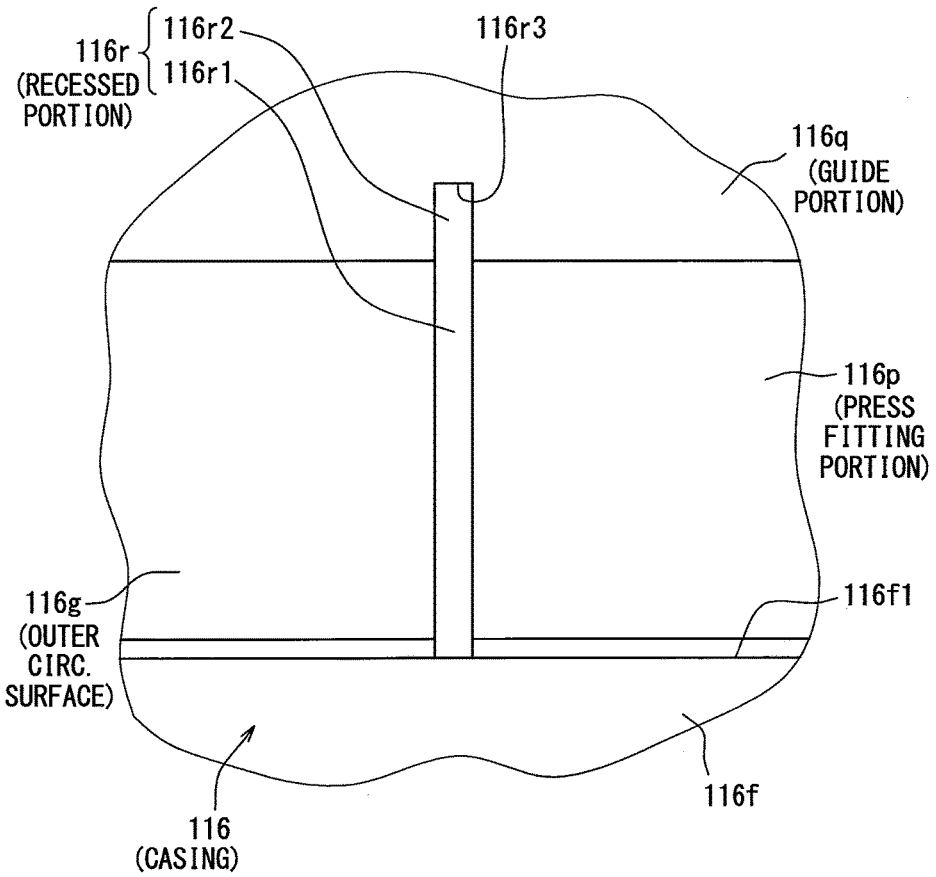
FIG. 7 is a view along arrow VII of FIG. 6.

As shown in FIGS. 3, 4, and 7, recessed portions 116*r* are formed at predetermined locations in the circumferential direction of the outer circumferential surface 116*g* of the casing 116. The recessed portions 116*r* recess toward a radial center of the outer circumferential surface 116*g*. The recessed portions 116*r* are formed at a plurality of locations (4 locations in the example of FIG. 3) in the circumferential direction of the casing 116. The plurality of recessed portions 116*r* are disposed with even spacing in the circumferential direction. At least one of the plurality of recessed portions 116*r* is disposed on an imaginary line represented by the eccentric direction De.

Figure 8:
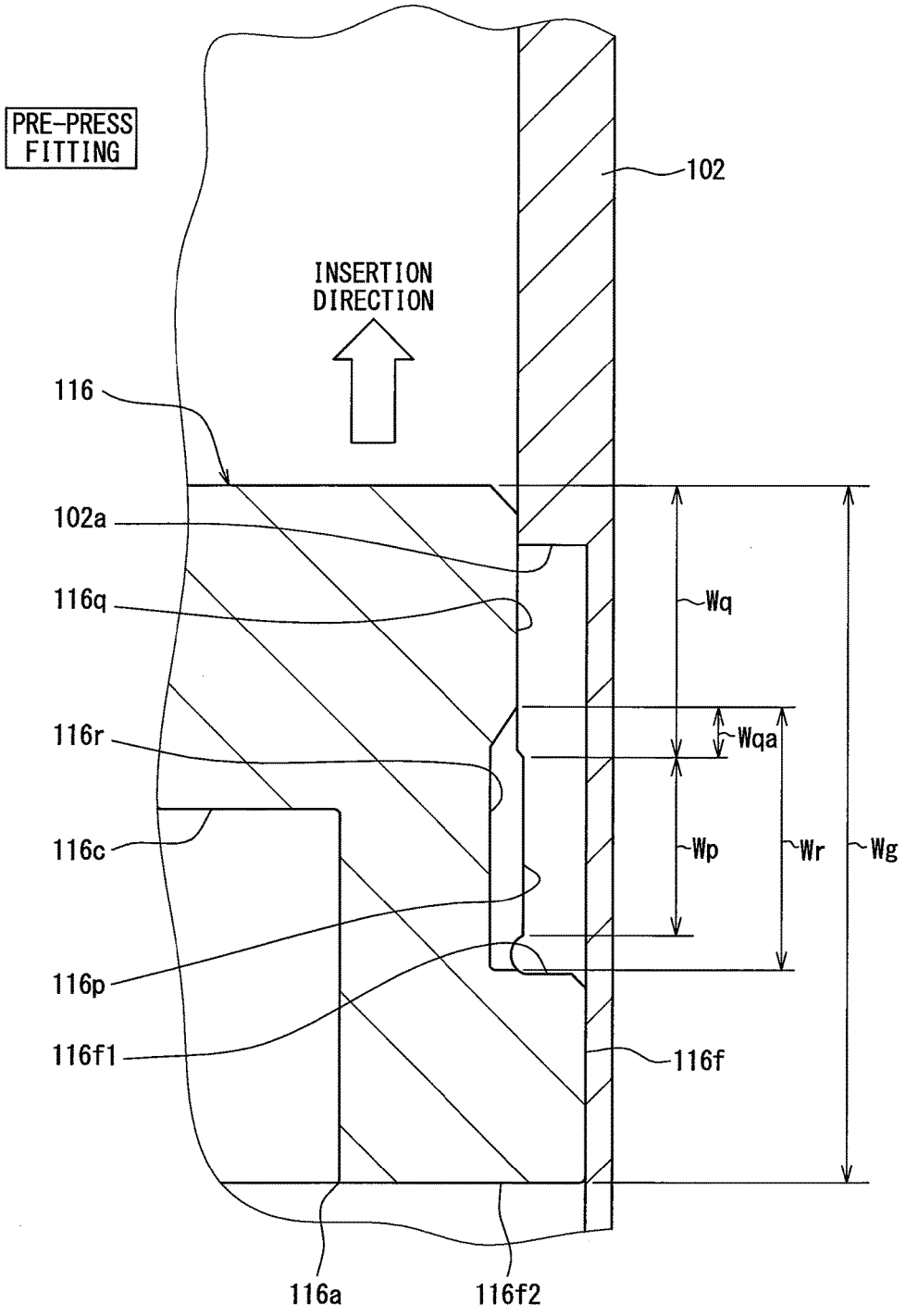
FIG. 8 is a cross section view showing a casing and a housing of a first embodiment in a pre-press fitting state.
Figure 13:
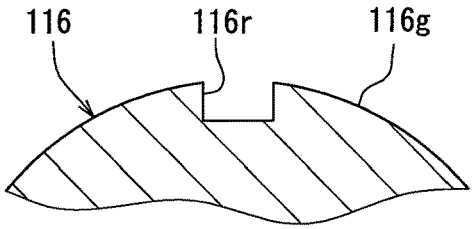
FIG. 13 is a cross section view of a casing showing the shape of a recessed portion according to a first embodiment.

The recessed portions 116*r* are formed to extend in the axial direction (refer to FIG. 7), and are shaped with a rectangular cross section (refer to FIG. 13). As shown in FIG. 8, the recessed portions 116*r* are partially formed in a predetermined region Wr among an entire axial direction region Wg of the outer circumferential surface 116*g*. This predetermined region Wr includes an entire region Wp of the press fitting portion 116*p*. Further, the predetermined region Wr, in which the recessed portions 116*r* are formed, includes a partial region Wqa of an entire region Wq of the guide portion 116*q*. The partial region Wqa is adjacent to the press fitting portion 116*p*.

Figure 9:
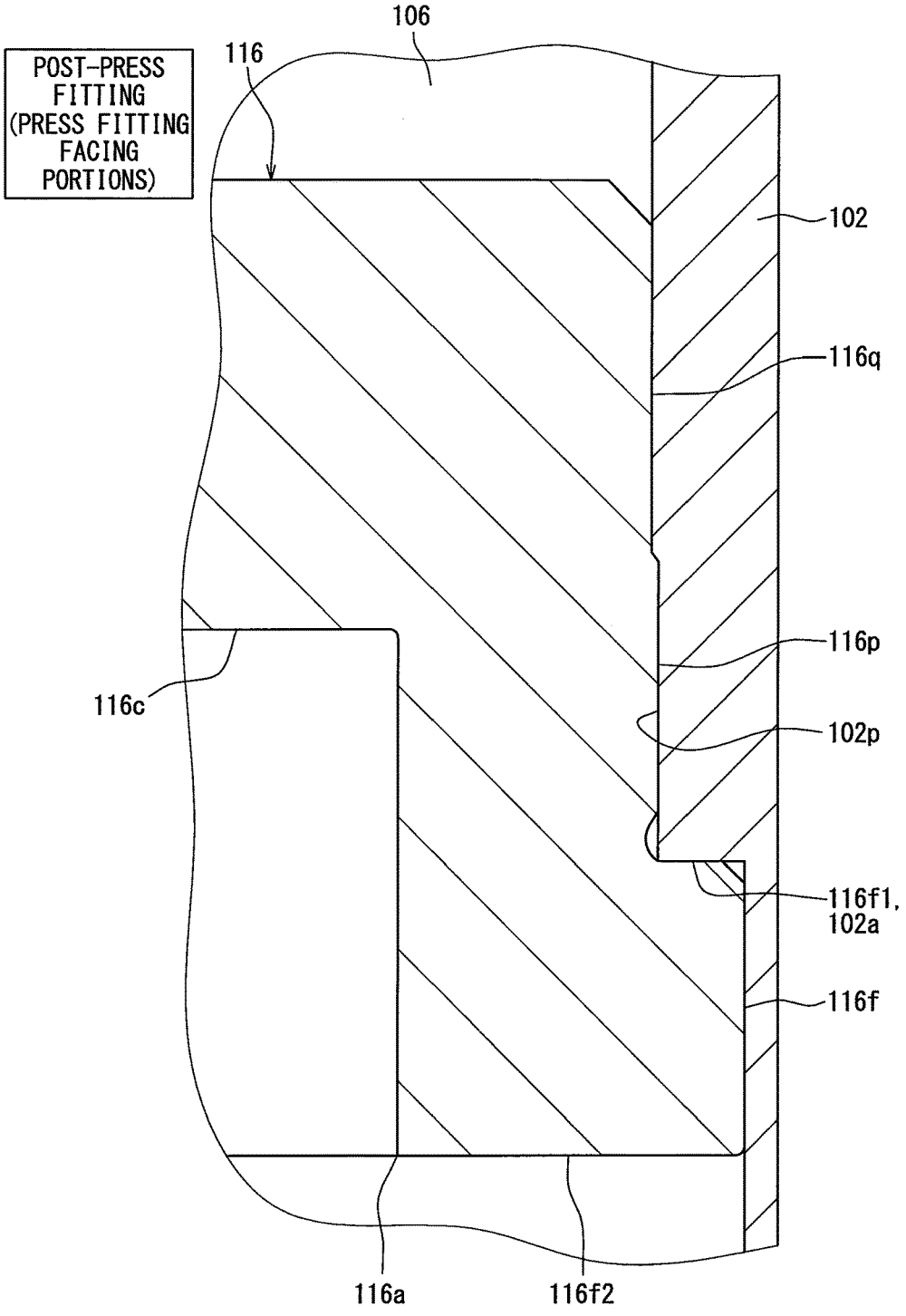
FIG. 9 is a cross section view showing a casing and a housing of a first embodiment in a post-press fitting state and a press fitting deformed state due to a press fitting portion.
Figure 10:
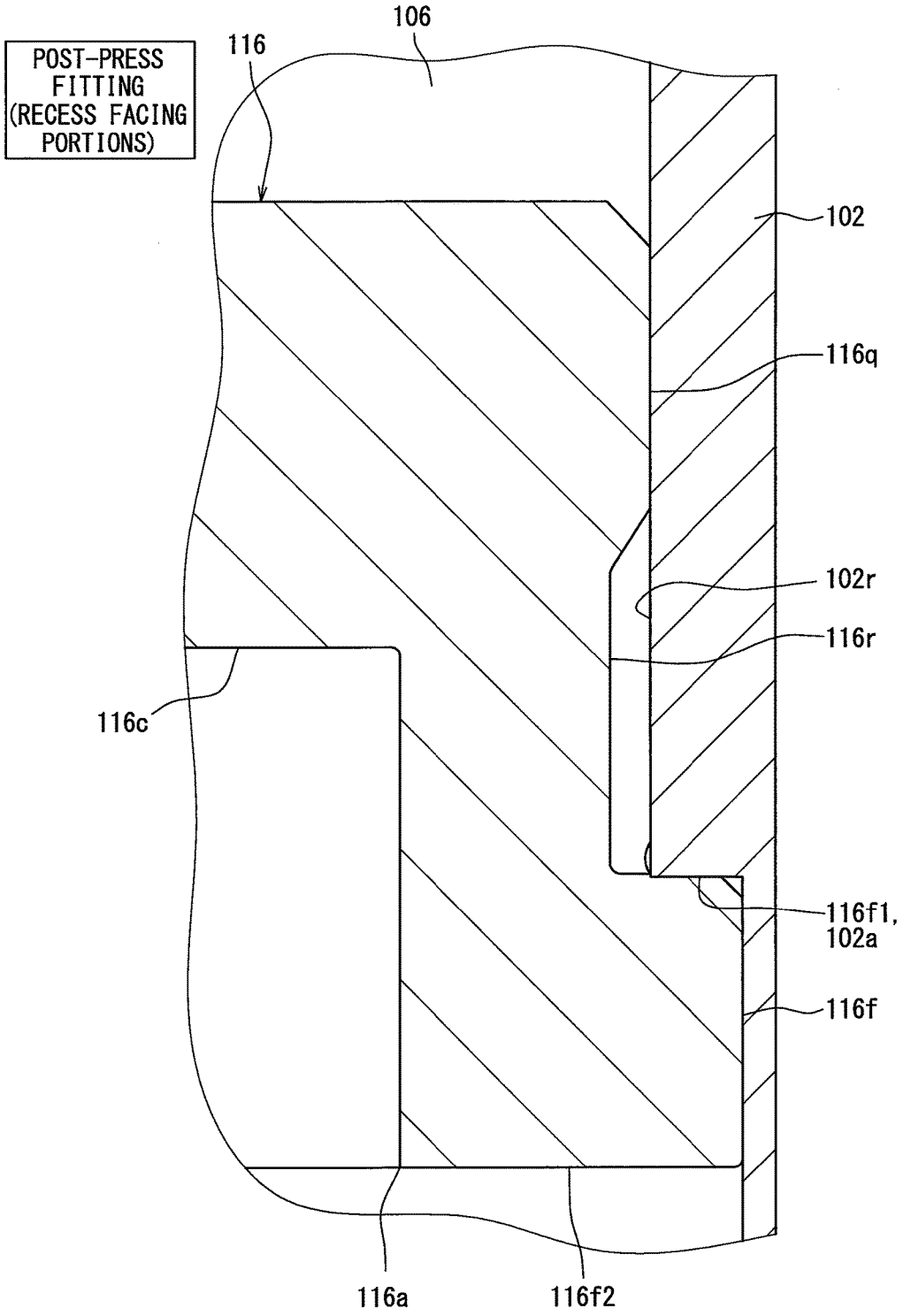
FIG. 10 is a cross section view showing a casing and a housing of a first embodiment in a post-press fitting state and a state in which press fitting deformation is suppressed due to a recessed portion.
Figure 11:
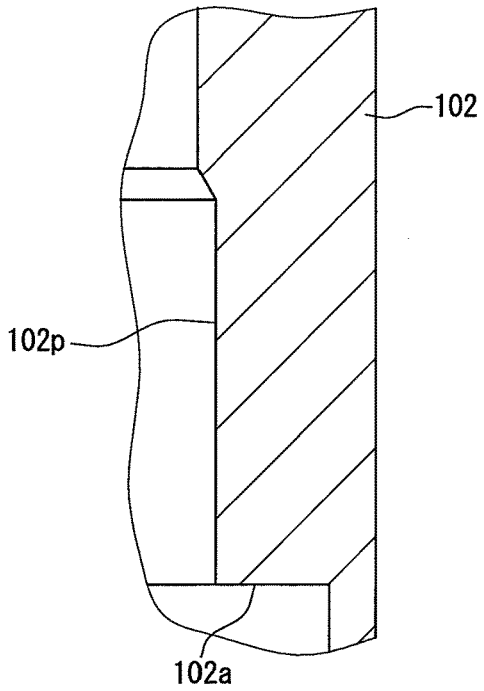
FIG. 11 is a cross section view showing a standalone housing of FIG. 9.
Figure 12:
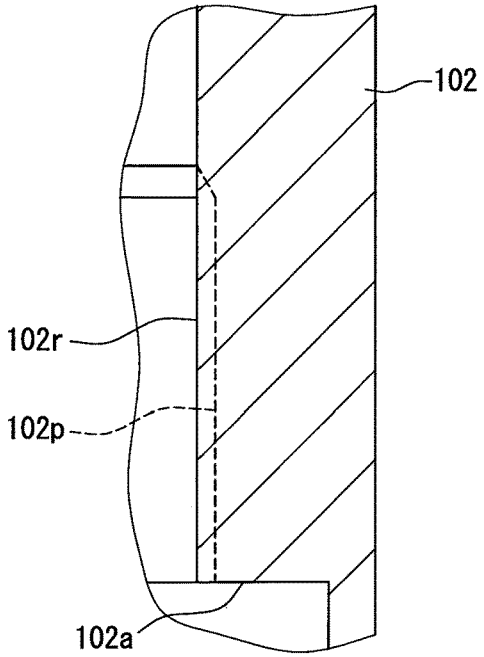
FIG. 12 is a cross section view showing a standalone housing of FIG. 10.

As shown in FIGS. 9 and 11, a press fitting deformation portion 102*p* of the housing 102 does not face the recessed portions 116*r*. The press fitting deformation portion 102*p* deforms (press fitting deforms) so as to be enlarged in the radial direction as the casing 116 is press fit into the housing 102. Accordingly, the casing 116 is fixedly press fit into the housing 102. Meanwhile, as shown in FIGS. 10 and 12, recess facing portions 102*r* of the housing 102 face the recessed portions 116*r*. The recess facing portions 102*r* are suppressed from press fitting deforming, i.e., suppressed from enlarging in the radial direction. As a result, as shown in FIG. 3, the recess facing portions 102*r* become inserted into the recessed portions 116*r*.

Next, an assembly procedure of the pump body 103 will be explained. The radial bearing 150 is fixedly press fit into the throughhole 116*e* of the casing 116 either after the casing 116 is press fit into the housing 102 as described above, or before that press fitting. After the casing 116 is press fit into the housing 102 and the radial bearing 150 is fixedly press fit into the throughhole 116*e* of the casing 116, the rotating shaft 104*a* is inserted into the radial bearing 150. Then, the inner rotor 120 is inserted onto the radial bearing 150, and the outer rotor 130 is positioned so that the outward teeth 122 are geared with the inward teeth 132*a*. Next, the joint member 160 is inserted onto the rotating shaft 104*a* and, at the same time, the leg portions 164 are inserted into the opposing intake groove 118. Next, while the cover 112, which has the thrust bearing 152 disposed, is adhered to the casing 116, the front end of the housing 102 is plastically deformed inward in the radial direction, thereby fixedly crimping the housing 102 to the cover 112.

According to the above described adherence, the cover 112 is pressed in the axial direction against the casing 116 with a predetermined load. Due to this pressing, a lower seal surface 116*f*2 formed on the expanded diameter portion 116*f* of the casing 116 is adhered with a seal surface 112*b* of the cover 112 (refer to FIG. 5), forming a seal such that fuel does not leak out. Further, due to the above described pressing, an upper seal surface 116*f*1 of the expanded diameter portion 116*f* is adhered with a seal surface 102*a* of the housing 102 (refer to FIGS. 9, 10). Due to this, a seal is formed such that fuel from the high pressure passage 106 does not leak out from between the outer circumferential surface 116*g* of the casing 116 and the inner circumferential surface of the housing 102, or between the outer circumferential surface of the cover 112 and the inner circumferential surface of the housing 102.

Foreign substances such as dust may be included in the fuel supplied from a fuel tank of the vehicle. If this foreign substance becomes stuck between the outward teeth 122 and the inward teeth 132*a*, there is a chance for the outer rotor 130 to enter a locked state in which the outer rotor 130 is unable to rotate relative to the inner rotor 120. In addition, since the outer rotor 130 is disposed eccentrically with respect to the inner rotor 120, when a rotating driving force is applied by the rotating shaft 104*a* during the locked state, the outer rotor 130 becomes pressed against the inner circumferential surface 116*b* of the casing 116. In other words, the outer rotor 130 and the casing 116 become a single body, and the rotating force that tries to rotate the housing 102 inner portion is applied to the casing 116. There is a concern that due to this rotation force, if the casing 116 rotates with respect to the housing 102, the discharge passage 117 may be positionally displaced from an optimum position, and that pump efficiency may deteriorate causing the discharge amount to decrease. In particular, if a small positional displacement occurs, then the discharge amount only decreases by a small amount, and it is difficult to notice that pump efficiency is decreased due to the positional displacement.

In view of the above concern, according to the present embodiment, the recessed portions 116*r* are formed at predetermined locations in the circumferential direction of the outer circumferential surface 116*g* of the casing 116. For this reason, while the press fitting deformation portion 102*p* of the housing 102 deforms under press fitting, the recess facing portions 102*r* of the housing 102 are suppressed from press fitting deformation. As a result, the recess facing portions 102*r* become inserted into the recessed portions 116*r*. Accordingly, even if a large rotation force is applied to the casing 116 due to foreign substances becoming stuck as described above, the recess facing portions 102*r* are caught on the wall surfaces of the recessed portions 116*r*, and function as rotation stoppers for the casing 116. As a result, according to the present embodiment, it is possible to suppress the casing 116 from being displaced in the rotation direction, and it is possible to suppress pump efficiency from deteriorating due to such a displacement.

Further according to the present embodiment, the recessed portions 116*r* are partially formed in the predetermined region Wr in the axial direction. As a comparative example to this configuration, if the recessed portions 116*r* are formed over the entire region in the axial direction, then the recess facing portions 102*r* and the recessed portions 116*r* become guides that extend over the entire region in the axial direction, and it is easy for the casing 116 to slip out of the housing 102 in the axial direction. In this regard, since the recessed portions 116*r* of the present embodiment are partially formed in the axial direction, the casing 116 may be suppressed from displacing in the axial direction with respect to the housing 102.

Further according to the present embodiment, the casing 116 includes the press fitting portion 116*p* which is press fit into the housing 102, and the guide portion 116*q* which is disposed adjacent to the press fitting portion in the axial direction and which guides the housing 102 toward the press fitting portion 116*p* during press fitting. For this reason, during press fitting, the housing 102 is guided toward the press fitting portion 116*p* by the guide portion 116*q*, and productivity during press fitting is improved.

Further according to the present embodiment, the entire region Wp of the press fitting portion 116*p* is included in the predetermined region Wr in which the recessed portions 116*r* are formed. For this reason, the recess facing portions 102*r* of the housing 102 are formed in a region that includes the entire region Wp of the press fitting portion 116*p*. As compared to when the recess facing portions 102*r* of the housing 102 are formed in a region that does not include the entire region Wp of the press fitting portion 116*p*, the length over which the recess facing portions 102*r* become stuck by a recessed wall surface increases. Accordingly, the rotating stopping ability of the recess facing portions 102*r* is improved.

Further according to the present embodiment, the partial region Wqa of the entire region Wq of the guide portion 116*q* is included in the predetermined region Wr in which the recessed portions 116*r* are formed. Here, the parts of the recess facing portions 102*r* that face the press fitting portion 116*p* (press fitting facing portions) deform to be enlarged slightly in the radial direction, due to being influenced by the portions of the housing 102 adjacent to the press fitting facing portions deforming due to press fitting. Meanwhile, the parts of the recess facing portions 102*r* that face the guide portion 116*q* (guide facing portions) are only affected by the above influence to a small extent, and thus almost no enlarging deformation occurs. For this reason, even if the casing 116 receives a force toward exiting the housing 102 in the axial direction, the guide facing portions become easily caught on the upper edge of the recessed portions 116*r*. Accordingly, the casing 116 is more securely fit in the housing 102.

Further according to the present embodiment, the joint member 160 is disposed to line up with the inner rotor 120 in the axial direction. The joint member 160 couples the inner rotor 120 with the rotating shaft 104*a* such that the rotation torque of the rotating shaft 104*a* is transmitted to the inner rotor 120.

It should be noted that typically, the viscosity of fuel increases as temperature decreases. In particular, when the fuel is diesel oil, the wax components included in the diesel oil separates, and viscosity greatly increases. When the viscosity of the fuel increases in this manner, the inner rotor 120 receives a large reaction force from the fuel, and the inner rotor 120 also receives a large force from the fuel toward tilting the inner rotor 120 with respect to the rotating shaft 104*a* (tilting force). As a result, a sliding resistance against the rotating shaft 104*a* and the radial bearing 150, which rotatably and slidably supports the rotating shaft 104*a*, may increase, leading to higher energy loss.

In this regard, according to the present embodiment, the inner rotor 120 is not directly connected to the rotating shaft 104*a*, but instead coupled through the joint member 160. As such, the above described tilting force is absorbed by elastic deformation of the joint member 160. Accordingly, the sliding resistance between the radial bearing 150 and the rotating shaft 104*a* may be decreased.

However, when coupled in this configuration, if foreign substances become stuck as described above, then the rotation force transmitted to the casing 116 increases due to absorbing the tilting force. Thus, it is even more preferable to suppress the casing 116 from positional displacement in the rotation direction. Accordingly, for the fuel pump 101 having the joint member 160, the positional displacement suppressing effects due to forming the recessed portions 116*r* are particularly suitable.

Second Embodiment

Figure 14:
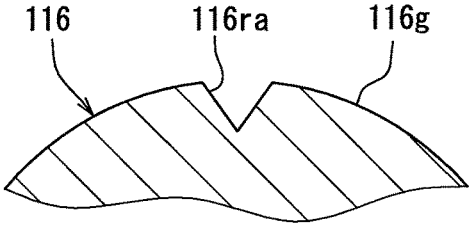
FIG. 14 is a cross section view of a casing showing the shape of a recessed portion according to a second embodiment of the present disclosure.

As shown in FIG. 13, the recessed portions 116*r* according to the above described first embodiment have rectangular shaped cross sections perpendicular to the axial direction. In this regard, as shown in FIG. 14, recessed portions 116*ra* according to the present embodiment have triangular shaped cross sections.

Third Embodiment

Figure 15:
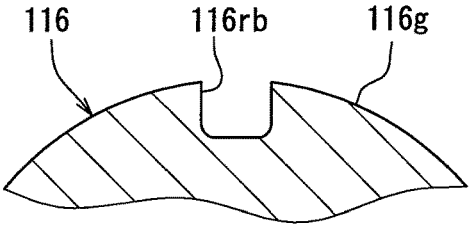
FIG. 15 is a cross section view of a casing showing the shape of a recessed portion according to a third embodiment of the present disclosure.

As shown in FIG. 15, recessed portions 116*rb* according to the present embodiment have cross sections perpendicular to the axial direction that are rectangular shaped with rounded corners.

Fourth Embodiment

Figure 16:
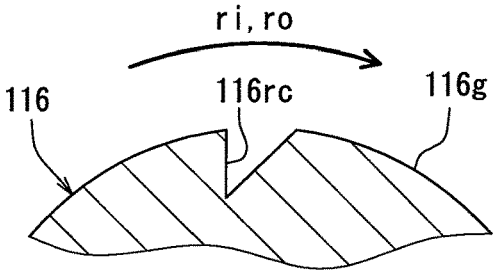
FIG. 16 is a cross section view of a casing showing the shape of a recessed portion according to a fourth embodiment of the present disclosure.

Each of the above described recessed portions 116*r*, 116*ra*, 116*rb* have cross section shapes with left-right symmetry. In this regard, according to the present embodiment as shown in FIG. 16, recessed portions 116*rc* are formed asymmetrically. Specifically, a wall surface of the recessed portions 116*rc* positioned opposite in the rotation directions Ri, Ro is sloped greater than a wall surface of the recessed portions 116*rc* positioned forward in the rotation directions Ri, Ro. More specifically, the wall surface positioned on an opposite side in the rotation directions Ri, Ro is formed to extend toward the rotation center.

As a result, the portion of wall surface of the recessed portions 116*rc* on which the recess facing portions 102*r* are caught is formed with a greater slope, and the recess facing portions 102*r* become caught more easily. Accordingly, the rotation stopping ability of the casing 116 is improved due to the recess facing portions 102*r* being caught on the recessed portions 116*rc*.

Other Embodiments

Above, embodiments of the present disclosure are explained, but the present disclosure is not intended to be limited to these embodiments, and a variety of modifications, which do not depart from the gist of the present disclosure, are contemplated.

According to the embodiment shown in FIG. 4, the recessed portions 116*r* are formed in a plurality of locations (in the example of FIG. 3, 4 locations) in the circumferential direction of the casing 116. Alternatively, one recessed portion may be formed at one location. However, it is preferable to form recessed portions at 3 or more locations.

The recessed portions 116*r* shown in FIG. 8 are partially formed in the predetermined region Wr in the axial direction. Alternatively, the recessed portions 116*r*, which extend in the axial direction, may be formed to extend over the entire axial direction region Wg of the outer circumferential surface 116*g*.

The predetermined region Wr of the recessed portions 116*r* shown in FIG. 8 includes the entire region Wp of the press fitting portion 116*p*. Alternatively, the predetermined region Wr may be set so as to partially include a portion of the press fitting portion 116*p*. Further, the predetermined region Wr of the recessed portions 116*r* shown in FIG. 8 includes the partial region Wqa of the guide portion 116*q*. Alternatively, the predetermined region Wr may be set so as to exclude the guide portion 116*q*.

The recessed portions 116*r* shown in FIG. 7 is formed to extend parallel to the axial direction. Alternatively, recessed portions may be formed to extend diagonally so as to intersect the axial direction.

According to the embodiment shown in FIG. 1, the inner rotor 120 is not directly coupled to the rotating shaft 104*a*. Instead, the joint member 160 couples the inner rotor 120 with the rotating shaft 104*a*. Alternatively, the inner rotor 120 may be directly coupled to the rotating shaft 104*a*, with the joint member 160 removed.

According to the embodiment shown in FIG. 4, the outward teeth 122 and the inward teeth 132*a* are shaped to draw the trajectories of trochoid curves, but may also be shapes other than trochoid curves, such as cycloid curves or combinations of different curves.

The liquid pumping target of the fuel pump 101 is not limited to diesel fuel, but may be other liquid fuels such as gasoline or alcohol. In addition, the fuel pump 101 is not limited to being mounted on a vehicle.

According to the embodiment shown in FIG. 1, the present disclosure is directly toward the fuel pump 101 integrally including the pump body 103 and the electric motor 104. However, the fuel pump 101 of the present disclosure may not include the electric motor 104, so that the electric motor 104 is separately provided. Further, according to the embodiment shown in FIG. 1, the inner rotor 120 is rotatably driven by the electric motor 104, but the inner rotor 120 may be driven by a portion of the motive driving force from, e.g., the crank shaft of the vehicle's internal combustion engine.

According to the embodiment shown in FIG. 1, the discharge passage 117 is disposed at an opposite side from the intake passage 112*a* in the axial direction in the cover 112 and the casing 116. Alternatively, the discharge passage 117 and the intake passage 112*a* may be disposed on the same side in the axial direction.

The invention claimed is:

1. A fuel pump, comprising:

an inner rotor including outward teeth;

an outer rotor including inward teeth, the inward teeth being geared with the outward teeth;

a casing that houses the outer rotor and the inner rotor, the casing forming a variable capacity pump chamber between the inward teeth and the outward teeth;

a housing formed in a cylindrical shape including a cylindrical inner portion, the casing being press fit into the cylindrical inner portion;

a rotating shaft which is rotatably driven; and a joint member disposed to line up in an axial direction with respect to the inner rotor, the joint member coupling the inner rotor to the rotating shaft so as to transmit a rotation torque of the rotating shaft to the inner rotor, wherein a recessed portion is formed at a predetermined position on the casing, the recessed portion extends in a circumferential direction for less than an entire circumference of an outer circumferential surface of the casing, and the recessed portion being is recessed toward a radial direction center of the outer circumferential surface.

2. The fuel pump of claim 1, wherein the recessed portion is partially formed in a predetermined region in an axial direction of the casing.

3. The fuel pump of claim 2, wherein the casing includes a press fitting portion which is press fit in the housing, and a guide portion disposed adjacent to the press fitting portion in the axial direction of the casing, the guide portion guiding being configured to guide the housing to the press fitting portion during a press fitting operation, and the predetermined region includes an entire region of the press fitting portion.

4. The fuel pump of claim 3, wherein the predetermined region includes a partial region of the guide portion.

5. The fuel pump of claim 2, wherein the casing includes a press fitting portion which is press fit in the housing, and a guide portion disposed adjacent to the press fitting portion in the axial direction of the casing, the guide portion being configured to guide the housing to the press fitting portion during a press fitting operation;

the guide portion has a smaller diameter than a diameter of the press fitting portion; and the predetermined region is formed across the press fitting portion and the guide portion.

* * * * *